US005730479A

United States Patent [19]

Jansson

[11] Patent Number: 5,730,479

[45] Date of Patent: Mar. 24, 1998

[54] COMPRESSED GAS CANISTER CARRIER

[76] Inventor: Karl Jansson, Unit 22, 8-12 Railway Crescent, Jannali, New South Wales 2226, Australia

[21] Appl. No.: 674,212

[22] Filed: Jul. 1, 1996

[51] Int. Cl.[6] ..... B25D 23/10

[52] U.S. Cl. ..... 294/31.2; 294/15

[58] Field of Search ..... 294/4, 15–17, 294/27.1, 29, 31.2, 32, 33, 137, 164, 165

[56] References Cited

U.S. PATENT DOCUMENTS

| | | | |
|---|---|---|---|
| 3,177,025 | 4/1965 | Short | 294/33 |
| 3,191,819 | 6/1965 | Smith | 294/27.1 X |
| 3,310,270 | 3/1967 | Ciancio | 294/31.2 X |
| 3,610,671 | 10/1971 | Conger | 294/27.1 X |
| 3,756,450 | 9/1973 | Crose | 294/31.2 X |
| 4,310,110 | 1/1982 | Dexter | 294/31.2 X |
| 4,336,899 | 6/1982 | Price | 294/27.1 X |
| 4,379,578 | 4/1983 | Schuler | 294/31.2 |
| 4,458,933 | 7/1984 | Thomas | 294/31.2 |
| 4,842,158 | 6/1989 | Reyes | 294/31.2 X |

*Primary Examiner*—Johnny D. Cherry
*Attorney, Agent, or Firm*—Ladas & Parry

[57] ABSTRACT

A device (10) for carrying an elongated, cylindrical gas canister (8) consists of a head (1) adapted to engage a portion of one end (14) of the canister (8), a handle (2) connected to the head (1), and a securing member (4) for essentially encircling a portion of the canister (8), wherein the securing member (4) is connected to the handle (2) at a position displaced lengthwise along the handle (2) from the head (1) to enable secure lifting and transportation of the canister (8). The head (1) is preferably formed of flexible material to accommodate a range of gas canisters (8). Alternatively, the head (1) is of a fixed shape to accommodate a specific type of gas canister (8). The securing member (4) is a strap arranged substantially as a loop and is made of a cross-stitched/woven nylon material. The handle (2) is made of metal, plastics, wood, or a combination thereof.

20 Claims, 2 Drawing Sheets

COMPRESSED GAS CANISTER CARRIER

FIELD OF THE INVENTION

The present invention relates to the field of transportation of compressed gas canisters generally and in particular to devices for manually carrying cylindrical, compressed gas tanks.

BACKGROUND OF THE INVENTION

Often, people carry a cylindrical, compressed gas canister, or tank, manually using only two fingers to grasp the valve of the canister. Transportation of generally large and awkward, cylindrical canisters in this fashion limits both the distance and the number of cylinders that can be transported by a person. The resulting stresses on the arm(s) of the person, and the fingers in particular, significantly limits the distance over which a person may carry the canister. This is further exacerbated when the canister is being transported over difficult terrain, such as when a person is walking across sand dunes or climbing staircases. This is further compounded by the weight of the canister.

As is well known, the transportation of gas canisters frequently results in personal injury to the person carrying the cylinder. Further, it is not uncommon for injury to other person(s) in proximity to the transported cylinder and/or damage to property to also happen due to the difficulty of controlling the cylinder during transportation.

There have been many prior art devices for carrying a compressed gas cylinder, but they have all required some form of strap or bracket which is temporarily mounted on the tank.

For example, one device for carrying compressed air cylinders used by scuba divers requires the user to mount a handle over the length of the cylinder using a velcro strap at the top and bottom of the cylinder. Such devices have the disadvantage that a compressed air cylinder cannot be lifted and carried with ease without the time consuming action of fitting the carrying device onto a cylinder.

SUMMARY OF THE INVENTION

In accordance with one aspect of the present invention, there is provided a device for carrying an elongated gas canister, comprising:

- a head adapted to engage a portion of one end of the canister;
- a handle connected to the head; and
- a securing member for essentially encircling a portion of the canister, the securing member connected to the handle at a position displaced lengthwise along the handle from the head to enable secure lifting and transportation of the canister.

Preferably, the elongated gas canister is substantially cylindrical in shape and may comprise a compressed air tank. Further, the portion of one end of the canister preferably comprises a valve receptacle, and may have a termination device connected to the valve receptacle.

Preferably, the head is formed of flexible material to accommodate a range of gas canisters. Alternatively, the head may be of a fixed shape to accommodate a specific type of gas canister.

Preferably, the securing member comprises a strap arranged substantially as a loop, and the strap may be connected by one or more fasteners to the handle. Alternatively, the handle is adapted to fasten the securing member therewith, and may incorporate a slotted receptacle for fastening the securing member.

Preferably, the strap is made of a cross-stitched/woven nylon material.

Preferably, the handle is made of metal, plastics, wood, or a combination thereof.

Preferably, the securing member is connected to the handle displaced from the head at a distance essentially more than half of the longitudinal length of the gas canister.

BRIEF DESCRIPTION OF THE DRAWINGS

The preferred embodiment of the present invention will now be described, in which.

DETAILED DESCRIPTION

Figure 1:
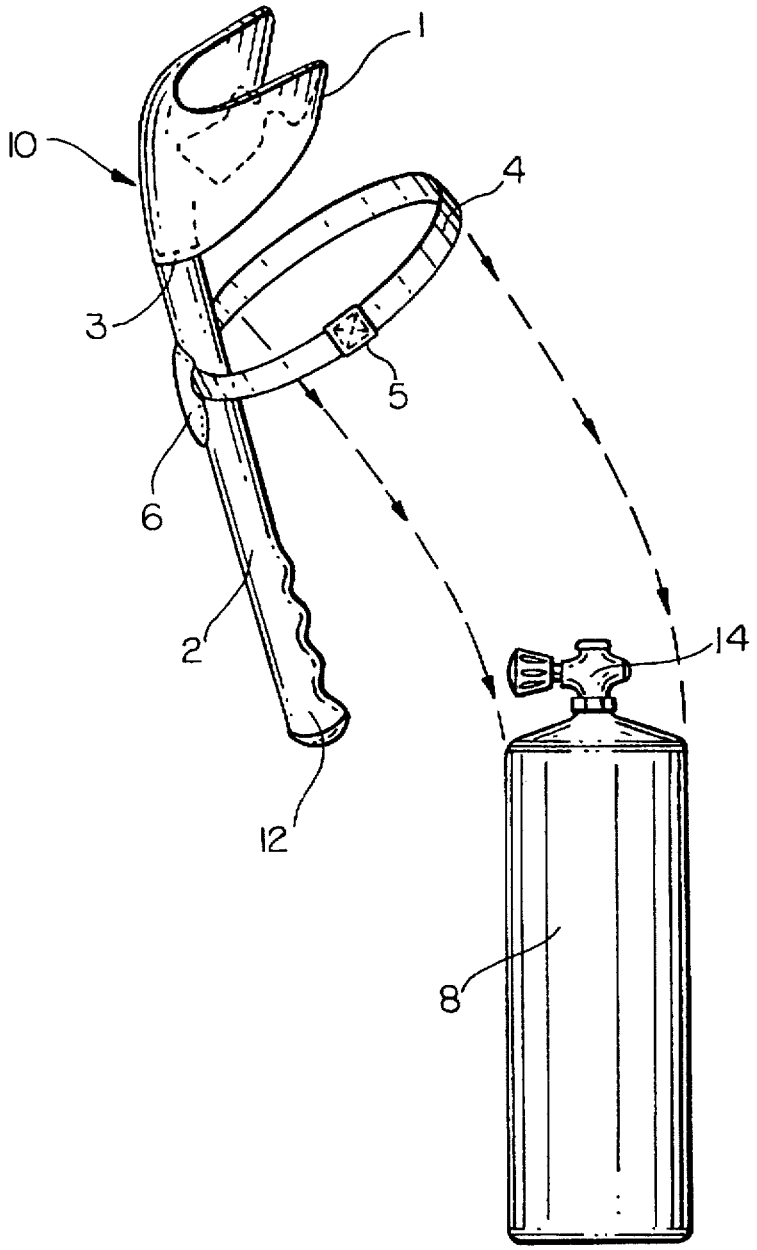
FIG. 1 is a perspective view of the carrying device according to the preferred embodiment positioned above a compressed gas cylinder prior to engagement.

A device 10 for carrying a compressed gas cylinder 8 according to the preferred embodiment of the invention shown in FIG. 1 comprises a head 1, a handle 2, and a strap 4.

The handle 2 preferably consists of a length of tube or a rod, and is made of a suitably strong, substantially rigid material such as metal, moulded plastic, wood, or a combination thereof. Preferably, the handle 2 has a grip 12 connected to the end of the handle 2 opposite that of the head 1. The grip 12 may be a separately attachable one, or alternatively may be formed by integrally moulding the grip in the handle 2, for example.

The head 1 is preferably attached to the handle 2 by means or a fastener 3, such as rivets or screws. It will be apparent to a person skilled in the art, however, that other means of connecting the head 1 and the handle 2 together may be practiced without departing from the scope and spirit of the invention. For example, the head 1 and the handle 2 may be consist of an integral structure made of moulded plastic or metal. Alternatively, the handle 2 may be made of wood and the head 1 may incorporate a cap-like structure for fitting on one end of the handle 2 as is commonly done with metal axe heads, and the like, and wooden handles.

Preferably, the head 1 of the carrying device 10 is made from a flexible material to accommodate a large range of sizes of valve heads 14 provided on the top of compressed gas cylinders 8. In another aspect of the invention, the head 1 of the carrier 10 may be rigid and formed specifically to meet the design of a fixture 14 at the top of the compressed gas cylinder 8. Preferably, the head 1 is substantially U-shaped as shown in FIG. 1.

Figure 2:
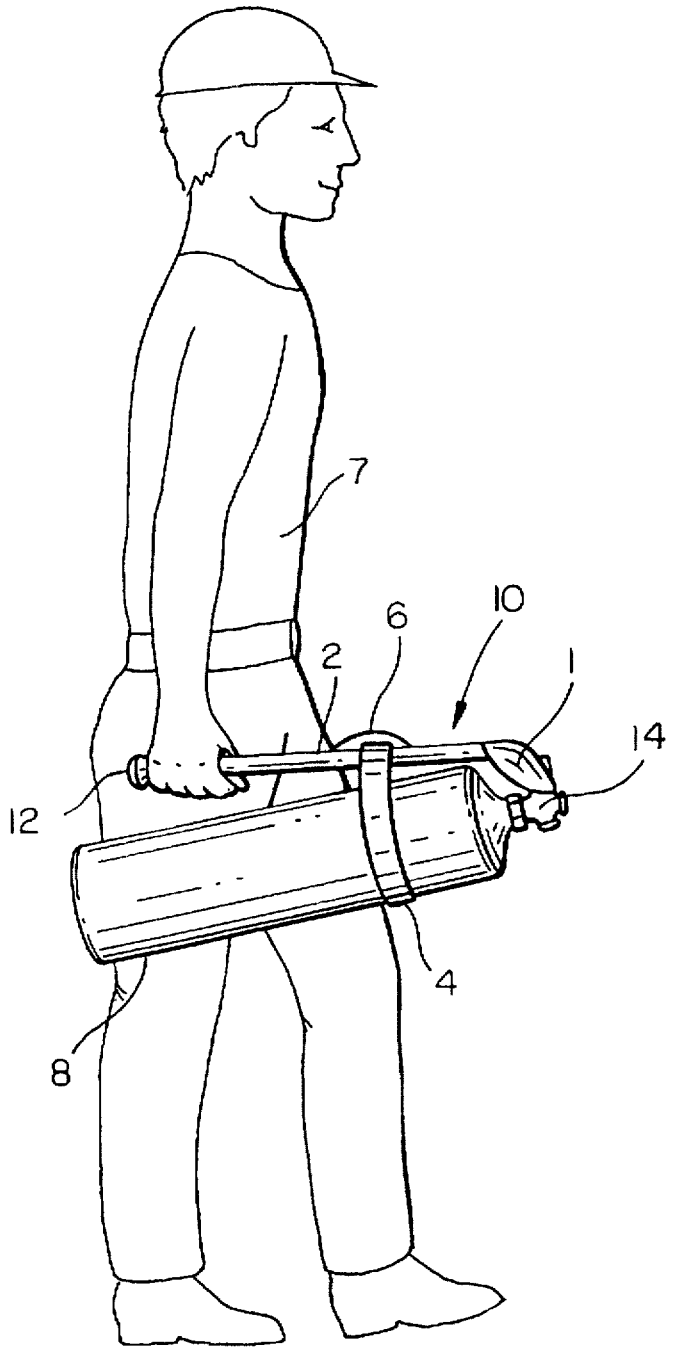
FIG. 2 is a side view of a person using the carrying device of FIG. 1 to transport the compressed gas cylinder in accordance with the invention.

It will be apparent to a person skilled in the art that the device 10 for carrying a compressed air cylinder 8 according to the invention is not restricted to the head shape shown in FIGS. 1 and 2. A head design to accommodate specific compressed air cylinder types may be practiced without departing from the scope and spirit of the invention.

The securing member or strap 4 is formed into a loop and the ends of the strap 4 are preferably sewn together, as represented by reference numeral 5 in FIG. 1. The carry strap 4 has a circumference to accommodate by loose fit a range of compressed gas cylinders 8. The strap 4 is fitted to the handle 2 by means of a bracket or slotted receptacle 6 to hold the strap's position on the handle 2.

Preferably, the carry strap 4 is made of cross stitched/woven nylon material similar to motor vehicle seat belts. However, it will be apparent to a person skilled in the art that the securing member 4 can be formed in a number of other manners and connected to the handle 2 without departing from the spirit and scope of the invention. The primary consideration for the arrangement of the securing member 4 is that it be capable of easily and readily fitting over the elongated, cylindrical canister 8 as indicated in FIG. 1 and that it be capable of supporting the suspended cylinder during transportation. For example, the securing member 4 may comprise a rigid, substantially circular structure made of rigid plastic complementarily dimensioned to the dimensions of the canister 8 to provide relatively snug engagement therebetween The carrying device 10 according to the preferred embodiment is advantageously capable of being readily and easily mounted on the canister 8 to lift and carry the canister 8. To do so, the carrying device 10 is manually lowered over the cylinder 8 so that the strap 4 passes over one end of the cylinder 8 and surrounds the cylinder 8. That is, the strap 4 is placed around the circumference of the compressed gas cylinder 8. The device 10 is lowered until the head 1 of the carrying device 10 is positioned in engagement with one end of the cylinder 8, and preferably over the valve 14 at the top of the compressed gas cylinder 8.

The cylinder 8 is tilted by hand at which point the weight of the cylinder 8 is transferred to the strap 4, and the carrying device 10 is ready to transport the compressed gas cylinder 8.

FIG. 2 illustrates the device 10 for carrying a compressed gas cylinder 8 in operation. As shown, the handle 2 is held by the user 7 grasping grip 12 with the weight of the compressed gas cylinder 8 met by the strap 4. The counteracting force of the compressed gas cylinder 8 on the strap 4 is met by the carrier head 1.

By use of the carrier device 10, the user 7 is able to manually lift and carry a compressed gas cylinder 8 easily without undue physical stress. In this way, sufficient clearance is provided between the canister 8 and the ground so that the user can travel over rough terrain, steps or similar obstacles.

Only a small number of embodiments of the present invention have been described and it will be apparent to a person skilled in the art that modifications can be made thereto without departing from the scope and spirit of the present invention.

I claim:

1. A device for carrying an elongated gas canister, comprising:

a head formed to engage a valve receptacle of said canister;

a rigid elongated handle connected to said head at one end, and an opposite end of said handle provided for grasping said carrying device by a user; and a securing member for loosely encircling a portion of said canister, said securing member connected to said handle at a position displaced lengthwise along said handle between said head and the opposite end of said handle;

wherein, in use of the device, the handle is used as a lever, in which the securing member supports the weight of said canister and the head engaged with the valve receptacle acts to counteract force of the canister on the securing member to enable secure lifting and transportation of said canister in a substantially horizontal position.

2. The device according to claim 1, wherein said gas canister is a cylindrical compressed air tank.

3. The device according to claim 1, further comprising a termination device connected to said valve receptacle.

4. The device according to claim 1, wherein said head is formed of flexible material to accommodate a range of gas canisters.

5. The device according to claim 1, wherein said head is of a fixed shape to accommodate a specific type of gas canister.

6. The device according to claim 1, wherein said securing member comprises a strap arranged substantially as a loop.

7. The device according to claim 6, wherein said strap is connected by at least one fastener to said handle.

8. The device according to claim 8, wherein said strap comprises cross-stitched/woven nylon material.

9. The device according to claim 1, wherein said securing member is fastened to said handle.

10. The device according to claim 9, wherein said handle incorporates a slotted receptacle for fastening said strap.

11. The device according to claim 1, wherein said handle is made of material selected from the group consisting of metal, plastics, a combination of metal and plastics, and wood.

12. The device according to claim 1, wherein said securing member is connected to said handle displaced from said head at a distance essentially more than half of the longitudinal length of the gas canister.

13. A manual lifting apparatus for transporting a portable gas tank, said gas tank having a valve receptacle at one end, said apparatus comprising;

means for gripping at least said valve receptacle of said gas tank;

an elongated lever member coupled to said gripping means at one end of said lever member, and an opposite end of said lever member for gripping by a user; and a lifting loop coupled to said lever member between said gripping means and said opposite end of said lever member to lift and transport said gas tank;

wherein said lifting apparatus is able to be positioned onto a gas tank, whereby said lifting loop encircles by loose fit a portion of said gas tank and said gripping means grips at least said valve receptacle.

14. The apparatus according to claim 13, wherein:

said gripping means comprises a formed head for grasping at least said valve receptacle, and said head is made of material selected from the group consisting of metal, plastic, and hardened rubber; and said lifting loop comprises a strap formed of material capable of supporting the weight of said gas tank.

15. The apparatus according to claim 13, wherein said lever member is made of material selected from the group consisting of metal, plastics, a combination of metal and plastics, and wood.

16. A hand-held tool for lifting and carrying a compressed gas cylinder, said tool comprising:

a head formed to connect firmly with a valve coupling portion of said gas cylinder;

an elongated, rigid handle having said head fastened to one end of said handle and an opposite end of said handle shaped to enable a person to grip said handle;

a belt coupled to said handle at a length from said head along said handle less than the axial length of said gas cylinder, said belt dimensioned for loosely surrounding a portion of said gas cylinder;

wherein the tool is able to be positioned over an upright gas cylinder and the opposite end of said handle is grasped by a user to lift said gas cylinder into a substantially horizontal carrying position with the handle acting as a lever, said belt supporting the weight of said gas cylinder and the head engaged with the valve coupling portion acting to counteract force of the gas cylinder on the belt.

17. The tool according to claim 16 wherein said head is shaped to connect firmly with both said portion of said gas cylinder and a valve disposed therein.

18. The tool according to claim 17 wherein said head is substantially U-shaped.

19. A device for carrying an elongated canister having a valve receptacle at an end thereof, the device comprising:

(a) a securing member for loosely encircling a portion of said canister; and (b) lever means, comprising a head and a handle to which the securing member is connected, for supporting the weight of said canister in a substantially horizontal position with the securing member loosely encircling the portion of the canister and with the head engaged with the valve receptacle to counteract force of the canister on the securing member.

20. A method for carrying an elongated canister having a valve receptacle at an end thereof, said method comprising:

(a) loosely encircling the elongated canister with a securing member of a device that comprises said securing member and lever means, comprising a head and a handle to which the securing member is connected, for supporting the weight of said canister in a substantially horizontal position with the securing member loosely encircling the portion of the canister and with the head engaged with the valve receptacle to counteract force of the canister in the securing member;

(b) engaging the head with the valve receptacle; and (c) grasping the handle and carrying the elongated canister in a substantially horizontal position.

* * * * *